US006613118B2

(12) United States Patent
Eckert

(10) Patent No.: US 6,613,118 B2
(45) Date of Patent: Sep. 2, 2003

(54) METHOD OF HEATING MOLTEN ALUMINUM IN A CRUCIBLE

(76) Inventor: C. Edward Eckert, 260 Lynn Ann Dr., New Kensington, PA (US) 15068

( * ) Notice: Subject to any disclaimer, the term of this patent is extended or adjusted under 35 U.S.C. 154(b) by 0 days.

(21) Appl. No.: 10/020,609

(22) Filed: Dec. 18, 2001

(65) Prior Publication Data

US 2003/0110893 A1 Jun. 19, 2003

(51) Int. Cl.[7] ..... C22B 21/06
(52) U.S. Cl. ..... 75/10.65; 75/678
(58) Field of Search ..... 75/686, 10.18, 75/10.65, 678

(56) References Cited

U.S. PATENT DOCUMENTS

| | | | | |
|---|---|---|---|---|
| 1,402,832 A | * | 1/1922 | Brown | 373/164 |
| 1,924,201 A | * | 8/1933 | Schuffler | 373/110 |
| 6,049,067 A | | 4/2000 | Eckert | 219/424 |

OTHER PUBLICATIONS

Miessler et al in Inorganic Chemistry, p. 173. 1991.*

* cited by examiner

*Primary Examiner*—Melvyn Andrews
(74) *Attorney, Agent, or Firm*—Andrew Alexander

(57) ABSTRACT

A container for molten metal which uses heat of solidification for heating the molten metal and method of heating body of molten aluminum.

3 Claims, 5 Drawing Sheets

METHOD OF HEATING MOLTEN ALUMINUM IN A CRUCIBLE

BACKGROUND OF THE INVENTION

This invention relates to molten aluminum, and more particularly, it relates to an improved crucible for use with molten metals such as molten aluminum to provide for extended delivery time.

As noted in U.S. Pat. No. 6,049,067, incorporated herein by reference, aluminum is frequently delivered to customers in molten form. The benefits are substantial energy savings and product availability in a ready-for-use (molten) condition. Trailer mounted transport crucibles are used for this purpose. Since the heat loss from these crucibles is high, transport time is limited to a few hours, and considerable superheat must be added to the metal to ensure delivery at minimum acceptable temperature. It is common practice to heat molten aluminum to temperatures above 1700° F. for the purpose of adding sufficient superheat. Direct impingement gas fired burners are used for this purpose.

Further, as noted, high temperature is undesirable because the resulting increase in metal oxidation rate generates skim. Melt loss can exceed 10%. Further, metal quality rapidly deteriorates since hydrogen solubility in aluminum is an exponential function of temperature, and oxides are formed. Refractory life is reduced by high temperature, and wall accretions build up and limit crucible metal capacity. The hazards associated with handling molten aluminum increase significantly with elevated temperature.

Another problem with molten metal such as molten aluminum involves transferring molten metal to and from the container or crucible because this requires the control of metal flow rate. The flow rate control is needed for operating, quality and safety considerations. The conventional means for controlling metal flow rate, for example, from a ladle by gravity includes varying the area available for metal flow. That is, when an orifice is positioned in the bottom of a ladle the size of the area of the orifice is changed to change the molten metal flow rate. Conventional means used to change the orifice area include a tapered rod or sometimes a slide gate. However, these provide no means for molten metal flow rate other than by varying the orifice area. Thus, when the ladle is full of molten metal, there is great force on the orifice, which when opened results in metal splashing and a hazardous situation. Further, there is an increase in oxides and reduced metal quality, particularly with molten aluminum, which readily oxidizes.

There is a need for a molten metal dispensing system which provides greater flow control and minimizes splashing. Further, there is a need for a heat sink to maintain molten metal at a temperature during transportation thereof.

SUMMARY OF THE INVENTION

It is an object of the invention to provide an improved container for molten metal.

It is another object of the invention to provide a container capable of extending delivery time for molten metal.

It is still another object of the invention to use pockets of metal or metal suitable heats of solidification to add heat to the molten metal during delivery.

These and other objects will become apparent from the specification, drawings and claims appended hereto.

Another embodiment of the invention contemplates a method of heating a body of molten metal in a crucible to add heat using heat of solidification to offset losses encountered during transportation or in holding in the crucible. The method comprises providing a crucible containing a body of molten metal, the crucible having a bottom and sides joined together to contain said molten metal, the sides having a liner comprised of a refractory substantially inert to the molten metal. The liner contains at least one pocket of a metal alloy having a melting point above that of the molten metal contained in the crucible. Heating means such as electric heaters are provided in the pocket for heating the metal or metal alloy to its melting point. As the metal or metal alloy solidifies, it supplies heat to the body of molten metal. That is, the metal or metal alloy gives up heat of transformation to the molten metal in the crucible thereby maintaining the molten metal at temperature for a greater period of time.

The invention also includes an improved container for containing molten metal which may be employed to maintain the molten metal at target temperature longer.

DETAILED DESCRIPTION OF THE PREFERRED EMBODIMENTS

Figure 1:
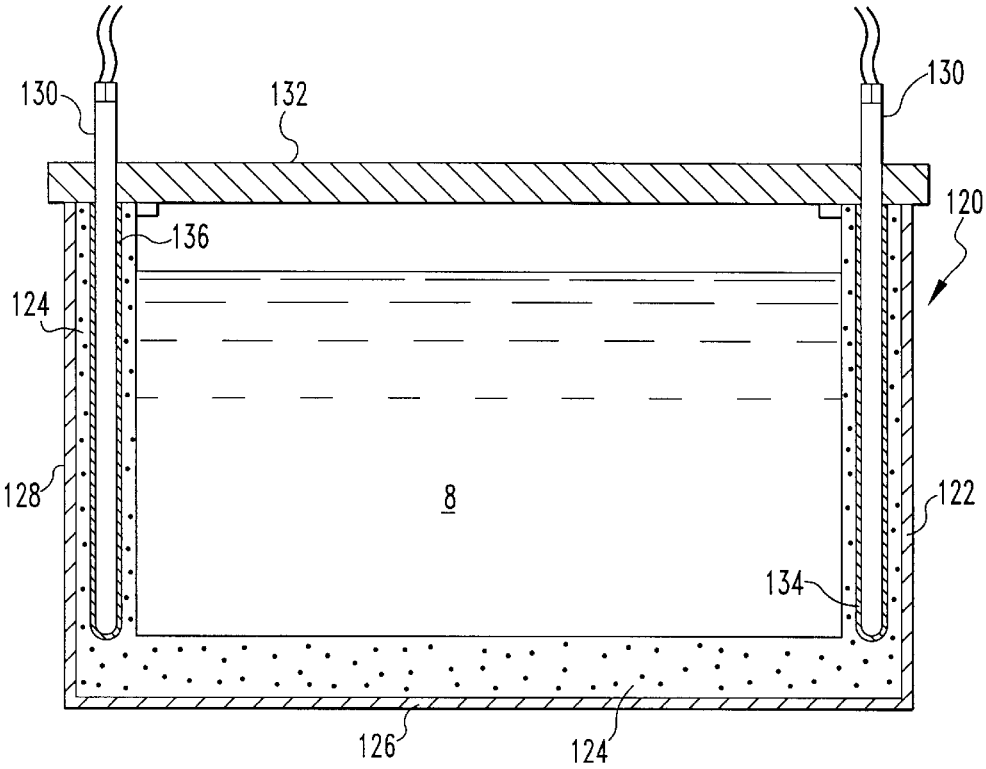
FIG. 1 is a cross-sectional view of a crucible showing heating elements in the liner.

In accordance with the invention, molten aluminum 8 is provided in a crucible 120 as shown in FIG. 1. Typically, such crucibles are circular although any shape may be used. Crucible 120 is comprised of a metal shell 122. A liner 124 is provided in crucible 120 for purposes of containing the molten aluminum. As can be seen from FIG. 1, liner 124 extends across bottom 126 and up side 128. Heating elements 130 are shown located in side 128 and heating elements (not shown) may be placed in bottom 126 or lid 132, if desired. Heating elements 130 are shown extending through lid 132 for purposes of illustration. However, the heating elements may be contained under lid 132.

The liner may be fabricated from any material which is resistant to attack by molten metal, e.g., molten aluminum. That is, the liner material should have high thermal conductivity, high strength, good impact resistance, low thermal expansion and oxidation resistance. Thus, the liner can be constructed from silicon carbide, silicon nitride, magnesium oxide, spinel, carbon, graphite or a combination of these materials with or without protective coatings. The liner material may be reinforced with fibers such as stainless steel fibers for strength. Liner material is available from Wahl Refractories under the tradename "Sifca" or from Carborundum Corporation under the tradename "Refrax™ 20" or "Refrax™ 60".

In forming the liner, preferably holes 134 having smooth walls are formed therein during casting for insertion of heaters thereinto. Further, it is preferred that the heating elements 130 have a snug fit with holes 134 in the liner for purposes of transferring heat to the liner. That is, it is preferred to minimize the air gaps between the heating element and the liner. Sufficient clearance should be provided in the holes to permit extraction of the heating element, if necessary. Tubes or sleeves 136 (FIGS. 3 and 4) may be cast in place in the liner material to provide for the smooth surface. Preferably, the tube has a strength which permits it to collapse to avoid cracking the liner material upon heating. If the tubes are metal, preferred materials are titanium or Kovar® or other such metals having a low coefficient of expansion, e.g., less than $7.5\times10^{-6}$ in/in/° F. Preferably, the tube is comprised of refractory material substantially inert to molten aluminum. That is, if after extended use, liner 124 is damaged and cracks and molten metal intrudes to heating element 130, it is desirable to protect against attack by the molten aluminum. Thus, it is preferred to use a refractory tube 136 to contain heating element 130 and protect it from the molten metal. Refractory tube 136 is comprised of a material such as mullite, boron nitride, silicon nitride, silicon aluminum oxynitride, graphite, silicon carbide, zirconia, stabilized zirconia and hexalloy (a pressed silicon carbide material) and mixtures thereof. Such material should have a high thermal conductivity and low coefficient of expansion. The refractory tube may be formed by slip casting, pressure casting and fired to provide the refractory or ceramic material with suitable properties resistant to molten aluminum. Metal composite material such as described in U.S. Pat. No. 5,474,282, incorporated herein by reference, may also be used.

For purposes of providing extended life of the heated liner, particularly when it is in contact with molten aluminum, it is preferred to use a non-wetting agent applied to the surface of the liner or incorporated in the body of the liner during fabrication. It is important that such non-wetting agents be carefully selected, particularly when the heating element is comprised of an outer metal tube. That is, when heating elements 130 are used in the receptacles or holes in the liner which employ a nickel-based metal sheath, the non-wetting agent should be selected from a material non-corrosive to the nickel-base metal sheath. That is, it has been discovered that, for example, sulfur containing non-wetting agents, e.g., barium sulfate, are detrimental. The sulfur from the non-wetting agent reacts with the nickel-based material of the metal sheath or sleeve. The sulfur reacts with the nickel forming nickel sulfide which is a low melting compound. This reaction destroys the protective, coherent oxide of the nickel-based sheath and continues until perforations or holes result in the sheath and destruction of the heater. It will be appreciated that the reaction is accelerated at temperatures of operation e.g., 1400° F. Other materials that are corrosive to the nickel-based sheath include halide and alkali containing non-wetting agents. Non-wetting agents which have been found to be satisfactory include boron nitride and barium carbonate and the like because such agents do not contain reactive material or components detrimental to the protective oxide on the metal sleeve of the heater.

In another aspect of the invention, a thermocouple (not shown) may be placed in the holes in the liner along with the heating element. This has the advantage that the thermocouple provides for control of the heating element to ensure against overheating of element 130. That is, if the thermocouple senses an increase in temperature beyond a specified set point, then the heater can be shut down or power to the heater reduced to avoid destroying the heating element.

For better heat conduction from the heater to the liner material, a contact medium such as a low melting point, low vapor pressure metal alloy may be placed in the heating element receptacle in the liner.

Alternatively, a powdered material may be placed in the heating element receptacle. When the contact medium is a powdered material, it can be selected from silica carbide, magnesium oxide, carbon or graphite. When a powdered material is used, the particle size should have a median particle size in the range from about 0.03 mm to about 0.3 mm or equivalent U.S. Standard sieve series. This range of particle size greatly improves the packing density of the powder and hence the heat transfer from the element to the liner material. For example, if mono-size material is used, this results in a one-third void fraction. The range of particle size reduces the void fraction below one-third significantly and improves heat transfer. Also, packing the particle size tightly improves heat transfer.

Heating elements that are suitable for use in the present invention are available from Watlow AOU, Anaheim, Calif. or International Heat Exchanger, Inc., Yorba Linda, Calif.

The low melting metal alloy can comprise lead-bismuth eutectic having the characteristic low melting point, low vapor pressure and low oxidation and good heat transfer characteristics. Magnesium or bismuth may also be used. The heater can be protected, if necessary, with a sheath of stainless steel; or a chromium plated surface can be used. After a molten metal contact medium is used, powdered carbon may be applied to the annular gap to minimize oxidation.

Any type of heating element 130 may be used. Because the liner extends above the metal line, the heaters are protection from the molten aluminum. Further, because the liner supplies the heat to the metal, small diameter heating elements can be used.

Using the liner heater of the invention has the advantage that no additional space is needed for heaters because they are placed in the liner.

In the present invention, it is important to use a heater control. That is, for efficiency purposes, it is important to operate heaters at highest watt density while not exceeding the maximum allowable element temperature, as noted earlier. The thermocouple placed in holes in the liner senses the temperature of the heater element. The thermocouple can be connected to a controller such as a cascade logic controller to integrate the heater element temperature into the control loop. Such cascade logic controllers are available from Watlow Controls, Winona, Minn., designated Series 988.

When refractory tubes are used to contain the heaters, it is preferred to coat the inside of the tube with a black colored material such as black paint resistant to high temperature to improve heat conductivity.

When the heaters are used in the liner, typically each heater has watt density of about 12 to 50 watt/in$^2$.

While heaters have been shown located in the liner, it will be appreciated that heaters may be inserted directly (not shown) into molten metal through lid 132 or side 128. Such heaters require protective sleeves or tubes as disclosed herein to prevent corrosive attack by the molten aluminum. Such heaters disposed directly in the melt have the advantage of higher watt densities as noted herein.

In addition, liner material may be attached to lid 132 in the form of a plate-shaped monolith or other shape (not shown) which projects into the molten aluminum when the lid is placed on the crucible. Heaters project through the lid into the monolith and add heat. However, this is a less preferred embodiment of the invention.

When the ladles are loaded on vehicles for transportation, electrical power for the heaters can be generated by an on-board power generator. The generator can be powered by any on-board engine such as gasoline, diesel or gas turbine engine. The gas turbine engine has the advantage that exhaust gases therefrom having a temperature of about 975° F. can be used as an extra source of heat. That is, a double metal walled crucible can be used with the exhaust gases passing through the double wall prior to escaping. This greatly facilitates or offsets the heat required to be provided by the electrical heaters.

Instead of a double wall, metal wall 122 of the crucible can be surrounded by a spiral wall (not shown) that surrounds crucible metal wall 122 and that wraps around the crucible a number of times, for example 2 or 3 times. Gases from the turbine enter the cavity developed by the spiral with hottest gases entering closest to the metal wall of the crucibles and coolest gases exiting at the exterior or coolest wall of the spiral. Thus, the spiral has the effect of more effectively using the hottest exhaust gases closest to the molten metal and effectively maintaining the crucible hotter, and minimizing the heat loss, and the make up heat to be added by the heaters. The temperature of the gases entering the spiral cavity can be in the range of 550° F. to 1350° F. and exiting the spiral cavity, 100° F. to 95° F.

Figure 3:
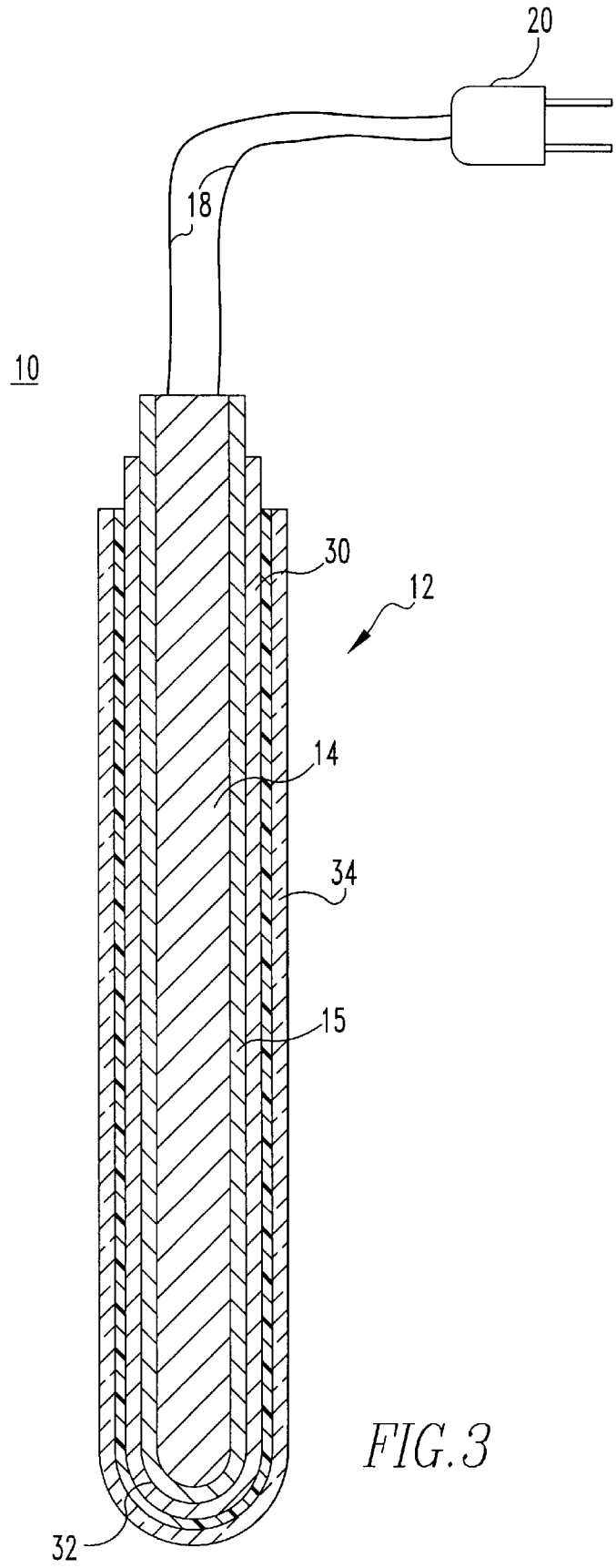
FIG. 3 is a cross-sectional view of an electric heater assembly in accordance with the invention.

Referring to FIG. 3, there is shown a schematic of an electric heater assembly 10 in accordance with the invention. The electric heater assembly is comprised of a protective sleeve 12 and an electric heating element 14. A lead 18 extends from electric heating element 14 and terminates in a plug 20 suitable for plugging into a power source. A suitable element 14 is available from International Heat Exchanger, Inc., Yorba Linda, Calif. 92687 under the designation P/N HTR2252.

Preferably, protective sleeve 12 is comprised of titanium tube 30 having an end 32 which preferably is closed. While the protective sleeve is illustrated as a tube, it will be appreciated that any configuration that protects or envelops electric heating element 14 may be employed. Thus, reference to tube herein is meant to include such configurations. A refractory coating 34 is employed which is resistant to attack by the environment in which the electric heater assembly is used. A bond coating may be employed between the refractory coating 34 and titanium tube 30. Electric heating element 14 is seated or secured in tube 30 by any convenient means. For example, swaglock nuts and ferrules may be employed or the end of the tube may be crimped or swaged shut to provide a secure fit between the electric heating element and tube 30. In the invention, any of these methods of holding the electric heating element in tube 30 may be employed. It should be understood that tube 30 does not always have to be sealed. In one embodiment, electric heating element 14 is encapsulated in a metal tube 15, e.g., steel or Inconel tube, which is then inserted into tube 30 to provide an interference or friction fit. That is, it is preferred that electric heating element 14 has its outside surface in contact with the inside surface of tube 30 to promote heat transfer through tube 30 into the molten metal. Thus, air gaps between the surface of metal tube 15 of electric heating element 14 and inside surface of tube 30 should be minimized.

If electric heating element 14 is inserted in tube 30 with a friction fit, the fit gets tighter with heat because electric heating element 14 expands more than tube 30, particularly when tube 30 is formed from titanium.

While it is preferred to fabricate tube 30 out of a titanium base alloy, tube 10 may be fabricated from any metal or metalloid material suitable for contacting molten metal and which material is resistant to dissolution or erosion by the molten metal. Other materials that may be used to fabricate tube 30 include silicon, niobium, chromium, molybdenum, combinations of NiFe (364 NiFe) and NiTiC (40 Ni 60TiC), particularly when such materials have low thermal expansion, all referred to herein as metals. Other metals suitable for tube 30 include: 400 series stainless steel including 410, 416 and 422 stainless steel; Greek ascoloy; precipitation hardness stainless steels, e.g., 15-7 PH, 174-PH and AM350; Inconel; nickel based alloys, e.g., unitemp 1753; Kovar, Invar, Super Nivar, Elinvar, Fernico, Fernichrome; metal having composition 30–68 wt. % Ni, 0.02–0.2 wt. % Si, 0.01–0.4 wt. % Mn, 48–60 wt. % Co, 9–10 wt. % Cr, the balance Fe. For protection purposes, it is preferred that the metal or metalloid be coated with a material such as a refractory resistant to attack by molten metal and suitable for use as a protective sleeve.

Further, the material or metal of construction for tube 30 may have a thermal conductivity of less than 30 BTU/ft hr ° F., and less than 15 BTU/ft hr ° F., with material having a thermal conductivity of less than 10 BTU/ft hr ° F. being useful. Another important feature of a desirable material for tube 30 is thermal expansion. Thus, a suitable material should have a thermal expansion coefficient of less than $15\times10^{-6}$ in/in/° F., with a preferred thermal expansion coefficient being less than $10\times10^{-6}$ in/in/° F., and the most preferred being less than $7.5\times10^{-6}$ in/in/° F. and typically less than $5\times10^{-6}$ in/in/° F. The material or metal useful in the present invention can have a controlled chilling power. Chilling power is defined as the product of heat capacity, thermal conductivity and density. Thus, the metal in accordance with the invention may have a chilling power of less than 5000 $BTU^2/ft^4$ hr ° F., preferably less than 2000 $BTU^2/ft^4$ hr ° F., and typically in the range of 100 to 750 $BTU^2/ft^4$ hr ° F.

As noted, the preferred material for fabricating into tubes 30 is a titanium base material or alloy having a thermal conductivity of less than 30 BTU/ft hr ° F., preferably less than 15 BTU/ft hr ° F., and typically less than 10 BTU/ft hr ° F., and having a thermal expansion coefficient less than $15\times10^{-6}$ in/in/° F., preferably less than $10\times10^{-6}$ in/in/° F., and typically less than $5\times10^{-6}$ in/in/° F. The titanium material or alloy should have chilling power as noted, and for titanium, the chilling power can be less than 500, and preferably less than 400, and typically in the range of 100 to 300 $BTU/ft^2$ hr ° F.

When the electric heater assembly is being used in molten metal such as lead, for example, the titanium base alloy need not be coated to protect it from dissolution. For other metals, such as aluminum, copper, steel, zinc and magnesium, refractory-type coatings should be provided to protect against dissolution of the metal or metalloid tube by the molten metal.

For most molten metals, the titanium alloy that should be used is one that preferably meets the thermal conductivity requirements, the chilling power and, more importantly, the thermal expansion coefficient noted herein. Further, typically, the titanium alloy should have a yield strength of 30 ksi or greater at room temperature, preferably 70 ksi, and typical 100 ksi. The titanium alloys included herein and useful in the present invention include CP (commercial purity) grade titanium, or alpha and beta titanium alloys or near alpha titanium alloys, or alpha-beta titanium alloys. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.

(b) 8 Al, 1 Mo, 1 V, the remainder Ti and impurities.

(c) 6 Al, 2 Sn, 4 Zr, 2 Mo, the remainder Ti and impurities.

(d) 6 Al, 2 Nb, 1 Ta, 0.8 Mo, the remainder Ti and impurities.

(e) 2.25 Al, 11 Sn, 5 Zr, 1 Mo, the remainder Ti and impurities.

(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11 V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 Al, 4 V, the remainder Ti and impurities.

(b) 6 Al, 6 V, 2 Sn, the remainder Ti and impurities.

(c) 8 Mn, the remainder Ti and impurities.

(d) 7 Al, 4 Mo, the remainder Ti and impurities.

(e) 6 Al, 2 Sn, 4 Zr, 6 Mo, the remainder Ti and impurities.

(f) 5 Al, 2 Sn, 2 Zr, 4 Mo, 4 Cr, the remainder Ti and impurities.

(g) 6 Al, 2 Sn, 2 Zn, 2 Mo, 2 Cr, the remainder Ti and impurities.

(h) 10 V, 2 Fe, 3 Al, the remainder Ti and impurities.

(i) 3 Al, 2.5 V, the remainder Ti and impurities.

The beta titanium alloys comprise, by wt. %, 0 to 14 V, 0 to 12 Cr, 0 to 4 Al, 0 to 12 Mo, 0 to 6 Zr and 0 to 3 Fe, the remainder titanium and impurities.

Specific beta titanium alloys contain, by wt. %, about:

(a) 13 V, 11 Cr, 3 Al, the remainder Ti and impurities.

(b) 8 Mo, 8 V, 2 Fe, 3 Al, the remainder Ti and impurities.

(c) 3 Al, 8 V, 6 Cr, 4 Mo, 4 Zr, the remainder Ti and impurities.

(d) 11.5 Mo, 6 Zr, 4.5 Sn, the remainder Ti and impurities.

When it is necessary to provide a coating to protect tube 30 of metal or metalloid from dissolution or attack by molten metal, a refractory coating 34 is applied to the outside surface of tube 30. The coating should be applied above the level to which the electric heater assembly is immersed in the molten metal. The refractory coating can be any refractory material which provides the tube with a molten metal resistant coating. The refractory coating can vary, depending on the molten metal. Thus, a novel composite material is provided permitting use of metals or metalloids having the required thermal conductivity and thermal expansion for use with molten metal which heretofore was not deemed possible.

Because titanium or titanium alloy readily forms titanium oxide, it is important in the present invention to avoid or minimize the formation of titanium oxide on the surface of titanium tube 30 to be coated with a refractory layer. That is, if oxygen permeates the refractory coating, it can form titanium oxide and eventually cause spalling of the refractory coating and failure of the heater. To minimize or prevent oxygen reacting with the titanium, a layer of titanium nitride is formed on the titanium surface. The titanium nitride is substantially impermeable to oxygen and can be less than about 1 $\mu$m thick. The titanium nitride layer can be formed by reacting the titanium surface with a source of nitrogen, such as ammonia, to provide the titanium nitride layer.

When the electric heater assembly is to be used for heating molten metal such as aluminum, magnesium, zinc, or copper, etc., a refractory coating may comprise at least one of alumina, zirconia, yittria stabilized zirconia, magnesia, magnesium titanite, or mullite or a combination of alumina and titania. While the refractory coating can be used on the metal or metalloid comprising the tube, a bond coating can be applied between the base metal and the refractory coating. The bond coating can provide for adjustments between the thermal expansion coefficient of the base metal alloy, e.g., titanium, and the refractory coating when necessary. The bond coating thus aids in minimizing cracking or spalling of the refractory coat when the tube is immersed in the molten metal or brought to operating temperature. When the electric heater assembly is cycled between molten metal temperature and room temperature, for example, the bond coat can be advantageous in preventing cracking, particularly if there is a considerable difference between the thermal expansion of the metal or metalloid and the refractory.

Typical bond coatings comprise Cr—Ni—Al alloys and Cr—Ni alloys, with or without precious metals. Bond coatings suitable in the present invention are available from Metco Inc., Cleveland, Ohio, under the designation 460 and 1465. In the present invention, the refractory coating should have a thermal expansion that is plus or minus five times that of the base material. Thus, the ratio of the coefficient of expansion of the base material can range from 5:1 to 1:5, preferably 1:3 to 1:1.5. The bond coating aids in compensating for differences between the base material and the refractory coating.

The bond coating has a thickness of 0.1 to 5 mils with a typical thickness being about 0.5 mil. The bond coating can be applied by sputtering, plasma or flame spraying, chemical vapor deposition, spraying, dipping or mechanical bonding by rolling, for example.

After the bond coating has been applied, the refractory coating is applied. The refractory coating may be applied by any technique that provides a uniform coating over the bond coating. The refractory coating can be applied by aerosol, sputtering, plasma or flame spraying, for example. Preferably, the refractory coating has a thickness in the range of 0.3 to 42 mils, preferably 5 to 15 mils, with a suitable thickness being about 10 mils. The refractory coating may be used without a bond coating.

In another aspect of the invention, boron nitride may be applied as a thin coating on top of the refractory coating. The boron nitride may be applied as a dry coating, or a dispersion of boron nitride and water may be formed and the dispersion applied as a spray. The boron nitride coating is not normally more than about 2 or 3 mils, and typically it is less than 2 mils.

The heater assembly of the invention can operate at watt densities of 25 to 250 watts/in$^2$ and typically 40 to 175 watts/in$^2$.

The heater assembly in accordance with the invention has the advantage of a metallic-composite sheath for strength and improved thermal conductivity. The strength is important because it provides resistance to mechanical abuse and permits an ultimate contact with the internal element. Intimate contact between heating element and sheath I.D. provides for substantial elimination of an annular air gap between heating element and sheath. In prior heaters, the annular air gap resulted in radiation heat transfer and also back radiation to the element from inside the sheath wall which limits maximum heat flux. By contrast, the heater of the invention employs an interference fit that results in essentially only conduction.

In conventional heaters, the heating element is not in intimate contact with the protection tube resulting in an annular air gas or space therebetween. Thus, the element is operated at a temperature independent of the tube. Heat from the element is not efficiently removed or extracted by the tube, greatly limiting the efficiency of the heaters. Thus, in conventional heaters, the element has to be operated below a certain fixed temperature to avoid overheating the element, greatly limiting the heat flux.

The heater assembly of the invention very efficiently extracts heat from the heating element and is capable of operating close to molten metal, e.g., aluminum temperature. The heater assembly is capable of operating at watt densities of 40 to 175 watts/in$^2$. The low coefficient of expansion of the composite sheath, which is lower than the heating element, provides for intimate contact of the heating element with the composite sheath.

Figure 2:
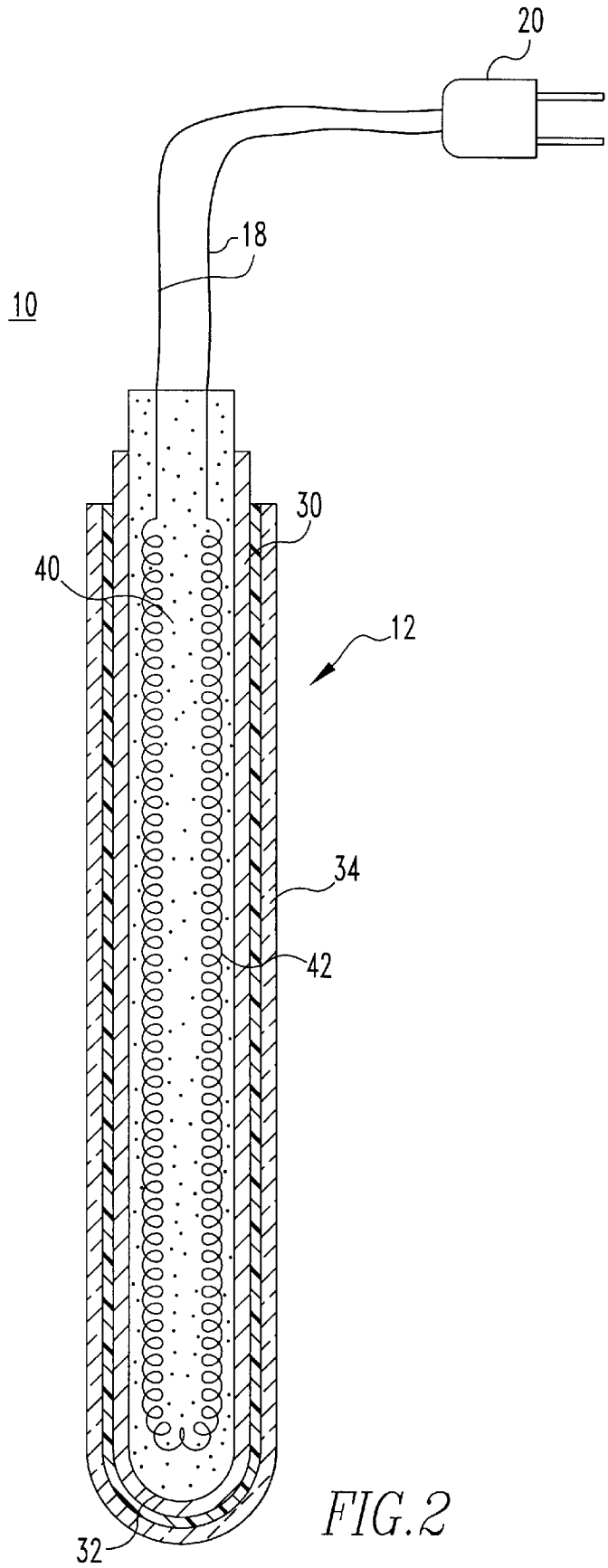
FIG. 2 is a cross-sectional view of an electric heater assembly showing a heating element and contact medium.

For better heat conduction from the heating element 42 (FIG. 2) to protective sleeve 12, a contact medium such as a low melting point, low vapor pressure metal alloy may be placed in the heating element receptacle in the baffle.

Alternatively, a powdered material 40 may be placed in the heating element receptacle. When the contact medium is a powdered material, it can be selected from silica carbide, magnesium oxide, carbon or graphite, for example. When a powdered material is used, the particle size should have a median particle size in the range from about 0.03 mm to about 0.3 mm or equivalent U.S. Standard sieve series. This range of particle size greatly improves the packing density of the powder and hence the heat transfer from electric element wire 42 (FIG. 2) to protective sleeve 12. For example, if mono-size material is used, this results in a one-third void fraction. The range of particle size reduces the void fraction below one-third significantly and improves heat transfer. Also, packing the range of particle size tightly improves heat transfer.

Heating elements that are suitable for use in the present invention are available from Watlow AOU, Anaheim, Calif. or International Heat Exchanger, Inc., Yorba Linda, Calif. These heating elements are often encased in Inconel tubes and use ICA or nichrome elements.

The low melting metal alloy can comprise lead-bismuth eutectic having the characteristic low melting point, low vapor pressure and low oxidation and good heat transfer characteristics. Magnesium or bismuth may also be used. The heater can be protected, if necessary, with a sheath of stainless steel; or a chromium plated surface can be used. After a molten metal contact medium is used, powdered carbon may be applied to the annular gap to minimize oxidation.

In another feature of the invention, a thermocouple (not shown) may be inserted between sleeve 12 and heating element 14 or heating element wire 42. The thermocouple may be used for purposes of control of the heating element to ensure against overheating of the element in the event that heat is not transferred away sufficiently fast from the heating assembly. Further, the thermocouple can be used for sensing the temperature of the molten metal. That is, sleeve 12 may extend below or beyond the end of the heating element to provide a space and the sensing tip of the thermocouple can be located in the space.

In the present invention, it is important to use a heater control. That is, for efficiency purposes, it is important to operate heaters at highest watt density while not exceeding the maximum allowable element temperature, as noted earlier. The thermocouple placed in the heater senses the temperature of the heater element. The thermocouple can be connected to a controller such as a cascade logic controller to integrate the heater element temperature into the control loop. Such cascade logic controllers are available from Watlow Controls, Winona, Minn., designated Series 988.

Heating element wire or member 42 of the present invention is preferably comprised of titanium or a titanium alloy. The titanium or titanium alloy useful for heating element member 42 can be selected from the above list of titanium alloys. Titanium or titanium alloy is particularly suitable because of its high melting point which is 3137° F. for high purity titanium. That is, a titanium element can be operated at a higher heater internal temperature compared to conventional elements, e.g., nichrome which melts at 2650° F. Thus, a titanium based element 42 can provide higher watt densities without melting the element. Further, electrical characteristics for titanium remain more constant at higher temperatures. Titanium or titanium alloy forms a titanium oxide coating or titania layer (a coherent oxide layer) which protects the heating element wire. In a preferred embodiment of the present invention, an oxidant material is added or provided within the sleeve of the heater assembly to provide a source of oxygen for purposes of forming or repairing the coherent titanium oxide layer. The oxidant may be any material that forms or repairs the titanium oxide layer. The source of oxygen can include manganese oxide or potassium permanganate which may be added with the powdered contact medium.

The oxidant, such as manganese oxide or potassium permanganate, can be added to conventional heaters employing a powder contact medium to provide a source of oxygen for conventional heating wire such as ICA elements. This permits conventional heating elements to be sealed.

Figure 4:
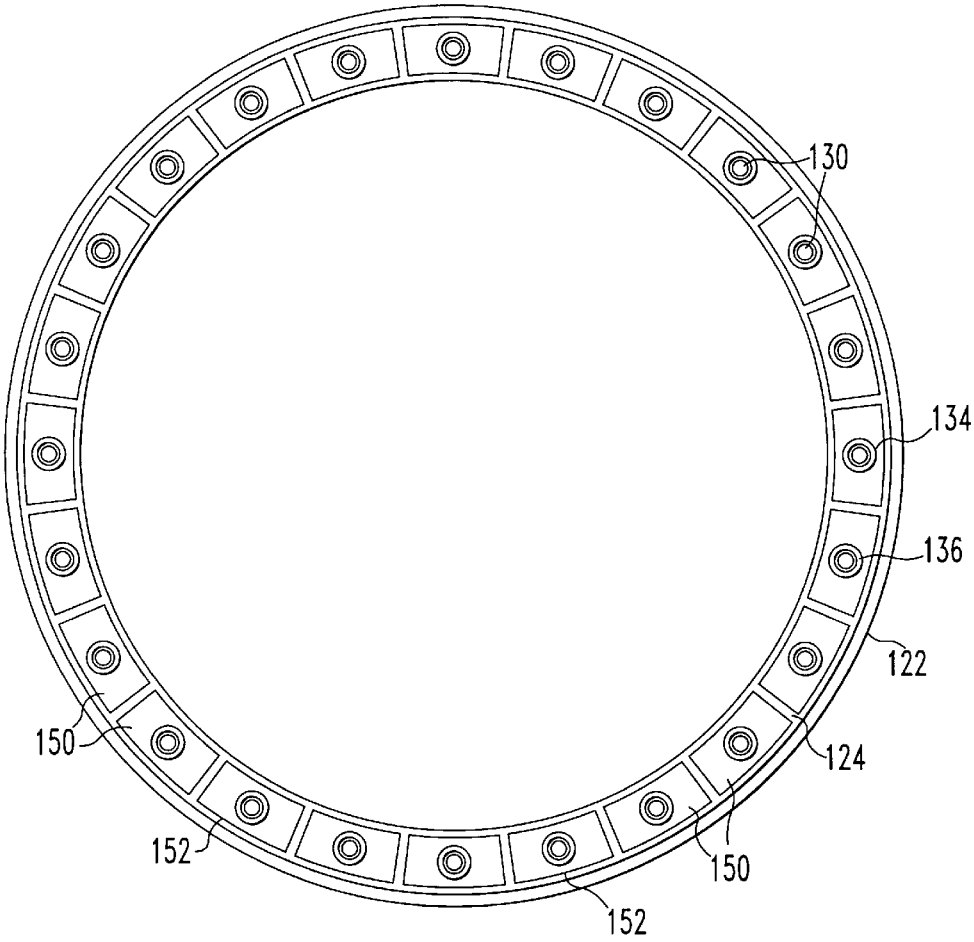
FIG. 4 is a view along the line A—A of FIG. 5 showing pockets of transformation metals.
Figure 5:
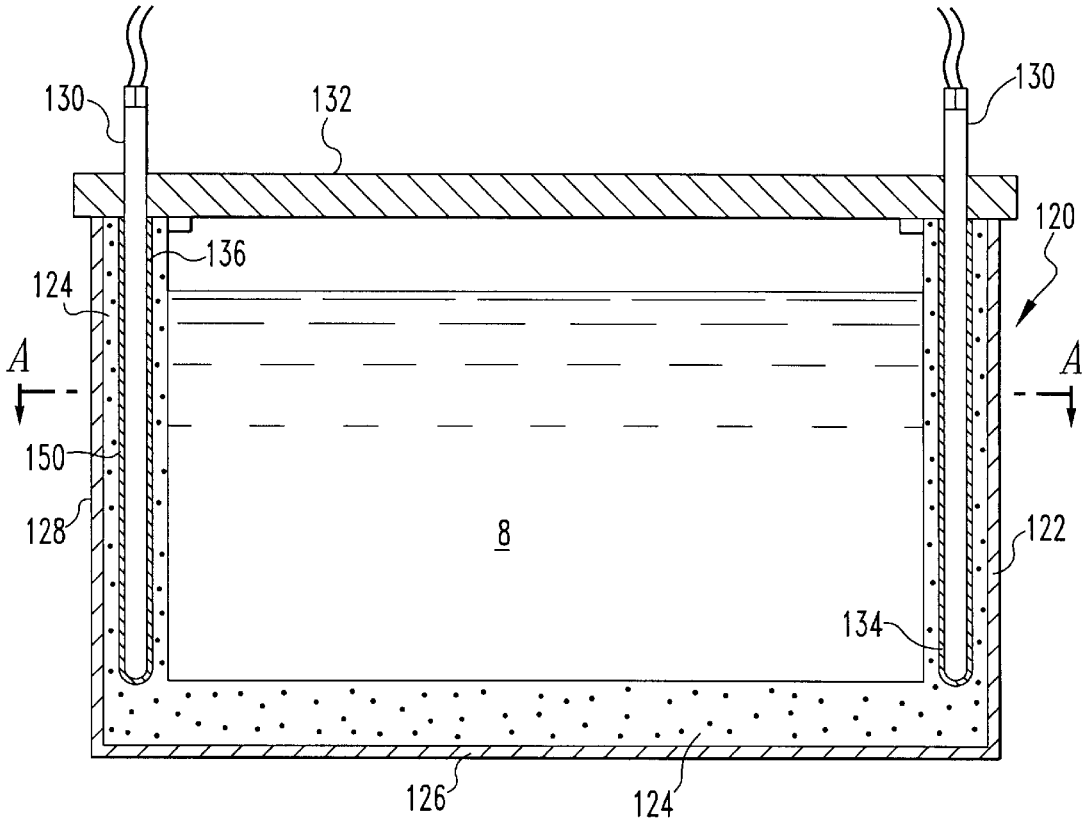
FIG. 5 is a cross-sectional view of a crucible showing heating elements in pockets of transformation metal.

FIG. 4 is a cross-sectional view along the line A—A of FIG. 5, and FIG. 5 is a view similar to FIG. 1 showing heaters located in the wall of the crucible or ladle. In FIGS. 1 and 5, like numbers designate like parts as described herein. In FIGS. 4 and 5, it will be seen that liner 124 contains pockets or bodies 150 of a transition metal or metal alloy. In FIG. 5, the pockets or bodies 150 are shown extending the depth of molten metal 8. Bodies 150 are illustrated in FIG. 4 as they may be applied to a circular crucible. It will be understood that FIG. 4 is illustrative, and different shaped bodies 150 may be used in liner 124. Further, different combinations of insulation comprising liner 124 may be used. That is, a greater depth or kind of liner may be employed between wall 152 of body 150 and shell 122 to direct the heat of solidification of the material constituting body 150 into the molten metal. Further, the material comprising liner 124 contacting molten metal 8 may be chosen to resist attacked molten metal 8 and to facilitate conduction of heat during heat of solidification of body 150. In addition, while bodies 150 are shown as a number of bodies, however, they may comprise a single body. Bodies 150 are required to be contained by liner 124 to prevent leakage of the metal or metal alloy when heated to melting. In addition, liner 124 needs to be compatible with body 150 in the molten condition.

In the present invention, bodies 150 of material having heat of fusion or heat of solidification at designated temperatures are designed to provide additional time at temperature for the molten metal contained in ladle or crucible 120. That is, the use of bodies 150 having a designated temperature or target temperature at which heat of solidification is liberated provides addition time at which molten metal 8 is maintained at a designated temperature. Heat of solidification or transformation heat is the heat liberated by a unit mass of liquid, e.g., molten metal or metal alloy, at its freezing point as it solidifies which is equal to its heat of fusion. Heat of solidification of bodies 150 provides additional time for delivery or dispensing molten metal 8 at a controlled temperature. Thus, this invention uses heat from a first order phase change, e.g., solidification of a liquid, preferably from a metal or metal alloy at a temperature of interest to provide enthalpy through exothermicity of the transformation. In the present invention, if a single metal is not available with the desired melting point, a eutectic or near eutectic alloy can be selected. Alloys are preferred that liberate transformation heat at near constant temperature. Further, the composition of the eutectic can be changed to provide residual liquid at a slightly lower temperature to facilitate heat transfer from heater 130 upon remelting of the metal or metal alloy for the next delivery. The following table provides metals or metal alloys that may be used for maintaining molten aluminum hot for a designated period.

| Alloy (wt. %) | T (m or e) ° F. | $H_f$, BTU/lb | ρ, lb/ft$^3$ | BTU/ft$^3$ | W-h/in$^3$ |
|---|---|---|---|---|---|
| 62 Ag-28 Cu | 1434 | 49.0 | 562.6 | 27,568 | 4.7 |
| 84 Cu-16 Si | 1476 | 160.6 | 492.8 | 79,137 | 13.4 |
| 39 Ca-61 Si | 1796 | 391.1 | 126.1 | 49,317 | 8.36 |
| 42 Mg-58 Si | 1742 | 419.2 | 129.7 | 54,378 | 9.22 |
| Al | 1220 | 167.5 | 166.7 | 27,923 | 4.73 |

For purposes of use with molten aluminum, the melting points of the metal or metal alloys are preferably 500 to 300° F. above that of molten aluminum or the target temperature which refers to the temperature at which the molten aluminum is to be used for casting, for example, and may be 25° F., for example, above the melting point of the molten aluminum. From the table, it will be seen that it is important to balance the heat liberated during solidification against the weight of bodies 150 contained in liner 150 to avoid interference with payload of the ladle.

It will be appreciated that heat of solidification or transformation heat can be applied to metals or material other than molten aluminum and such is contemplated within the purview of the invention.

While the invention has been described in terms of preferred embodiments, the claims appended hereto are intended to encompass other embodiments which fall within the spirit of the invention.

What is claimed is:

1. A method of heating a body of molten aluminum in a container to add heat to offset losses encountered during transportation or in holding in the container, the method comprising:

(a) providing a container having a body of molten aluminum, the container having:

(i) a bottom and sides joined together to contain said molten aluminum, said sides having a liner comprised of a refractory substantially inert to said molten aluminum; and (ii) said liner having at least one pocket of a transition metal or metal alloy having a melting point above that of the molten aluminum;

(b) providing at least one electric heating element in said pocket for heating said transition metal or metal alloy;

(c) heating said transition metal or metal alloy to said melting point; and (d) supplying heat to said body of molten aluminum as said transition metal or metal alloy gives up heat of transformation.

2. The method in accordance with claim 1 wherein the liner is comprised of a material selected from the group consisting of silicon carbide, silicon nitride, magnesium oxide, spinel, carbon and mixtures thereof.

3. A method of heating a body of molten aluminum in a crucible to add heat to offset losses encountered during transportation or in holding in the crucible, the method comprising:

(a) providing a crucible containing a body of molten aluminum, the crucible having:

(i) a bottom and sides joined together to contain said molten aluminum, said sides having a liner comprised of a refractory substantially inert to said molten aluminum; and (ii) said liner containing at least one pocket of a metal or metal alloy having a melting point above that of molten aluminum;

(b) heating said metal or metal alloy to said melting point; and (c) supplying heat to said body of molten aluminum as said metal or metal alloy gives up heat of solidification by changing from a liquid to a solid.

* * * * *